US005189457A

United States Patent [19]

Schlee et al.

[11] Patent Number: 5,189,457

[45] Date of Patent: Feb. 23, 1993

[54] SHEET PROCESSING APPARATUS AND METHOD

[75] Inventors: Ronald P. Schlee; Jeffrey L. Hall, both of Rochester, N.Y.

[73] Assignee: Eastman Kodak Company, Rochester, N.Y.

[21] Appl. No.: 826,718

[22] Filed: Jan. 28, 1992

[51] Int. Cl.[5] ..... G03D 3/04

[52] U.S. Cl. ..... 354/328

[58] Field of Search ..... 354/300, 328

[56] References Cited

U.S. PATENT DOCUMENTS

| | | | |
|---|---|---|---|
| 2,892,394 | 6/1959 | Hixon et al. | 354/328 X |
| 3,180,243 | 4/1965 | Siskind et al. | 134/94 |
| 3,259,049 | 7/1966 | Uithoven et al. | 134/94 |
| 3,291,025 | 12/1966 | Ross et al. | 354/328 X |
| 3,516,834 | 6/1970 | Audran et al. | 430/642 |
| 3,527,603 | 9/1970 | Seidel et al. | 430/390 |
| 4,248,513 | 2/1981 | Caccamisi | 354/328 |

*Primary Examiner*—Donald A. Griffin
*Assistant Examiner*—D. Rutledge
*Attorney, Agent, or Firm*—Clyde E. Bailey

[57] ABSTRACT

Apparatus 10 for processing photosensitive sheets in a tank 12 having a developer solution comprises a gas distributor 14 having a single gas distribution means 16 with at least two independent gas inlet lines 18,20 for providing a gas to the distributor 14. In another preferred embodiment, the gas distributor has independent first and second gas distribution means 26,28. In this embodiment, gas distributor 14 may be substantially star shaped and comprise a plurality of closed ended gas dispensing ducts 30 emanating from a common hub 32. In still another preferred embodiment, the gas distributor 14 is a substantially square shaped member comprising a plurality of closed ended dispensing ducts 30 alternatingly arranged in the same plane of member 31. The dispensing ducts 30 have a plurality of spaced openings 25 for emitting gas into the processing solution. In an alternative embodiment, an in-line check valve 36 prevents solution from flooding the gas distributor 14. A bursting means 22 independently controls the emittance of gas through dispensing ducts 30 in timed intervals such that the solution during its upward movement passes along the surface of the photosensitive sheets to provide uniform solution agitation. Photosensitive sheets simultaneously processed in accordance with the invention yield uniform sensitometric responses without mottle or streaks in the developed photographic image.

17 Claims, 6 Drawing Sheets

SHEET PROCESSING APPARATUS AND METHOD

FIELD OF THE INVENTION

The invention relates generally to photographic processing, and more particularly to improvements in photosensitive sheet processing apparatus and method for processing photographic sheets.

BACKGROUND OF THE INVENTION

Photographic apparatus for processing sheets of photosensitive material by immersing them in a processing solution are well known in the art. It is also known in the art that the chemical reactions that occur when the photosensitive material is immersed into these processing solutions quickly exhaust or very nearly exhaust the active chemical agents nearest the surface of the film. It has therefore been found that improved processing results if the solution is agitated during the processing operation. Although many ways are known for agitating a processing solution, one well known way utilizes gaseous burst agitation in which bursts of nitrogen gas or the like are released at controlled intervals through openings in a distributor disposed in the solution at the bottom of the processing tank. When first released, the bursts impart a sharp displacement pulse or piston action to the entire volume of solution, and then as the bubbles make their way to the surface they provide a localized agitation around each bubble.

An earlier gaseous burst type device used in photographic processing is disclosed and illustrated in U.S. Pat. No. 3,291,025, incorporated herein by reference. The device uses a single distributor for emitting a gas into the processing solution in a simultaneous burst. Other processing apparatus that utilize some sort of solution agitator are disclosed in U.S. Pat. Nos. 4,248,513 and 3,180,243. In each of these prior art processes, the gaseous burst occurs simultaneously throughout the distributor such that the distributor acts like a single unit. Additionally, the inlet ports are themselves simultaneously charged with a gas and, thus, function as a single delivery system.

A major drawback of the earlier processing apparatus is that they are known to produce nonuniform agitation patterns in the processing solution thereby resulting in sensitometric variations on simultaneously processed film. This has been known to occur in both 'rack and tank' and deep tank photographic development processes. Another drawback in both 'rack and tank' and in deep tank processing, is that nonuniform agitation results when the film strips are not rotated in the solution during processing. In either case, nonuniform agitation of the solution results in sensitometric variations in simultaneously processed photosensitive material. In aggravated cases, the nonuniformity of the development reaction may manifest itself as streaks or mottle in the developed photographic image.

Consequently, a need exists for an apparatus capable of producing uniform agitation in photosensitive sheet processing devices which will result in significantly reduced sensitometric variation in simultaneously processed photosensitive sheets.

SUMMARY OF THE INVENTION

It is, therefore, an object of the invention to provide an apparatus for processing sheets of photosensitive material which overcomes the shortcomings of the prior art.

Accordingly, for accomplishing these and other objects of the invention, there is provided an apparatus for processing sheets of photosensitive material in a tank containing a processing solution. The apparatus has a means, disposed in the solution, for distributing a gas in the tank. The gas distributor means has at least two independent gas inlet lines for alternately receiving a gas such that the gas can in turn be alternately dispensed in the tank in alternating bursting patterns for upward movement through the solution. Finally, a means for alternately bursting the gas through the gas distributor means is provided so that the gas burst during its upward movement produces uniform solution agitation.

Therefore, an important advantage of the invention is that photosensitive material simultaneously processed in the prescribed apparatus is exposed to more uniform solution agitation and will, therefore, have less variable sensitometric properties.

BRIEF DESCRIPTION OF THE DRAWINGS

The foregoing as well as other objects, features and advantages of this invention will become more apparent from the following detailed description when taken in conjunction with the appended figures in which.

DETAILED DESCRIPTION OF THE PREFERRED EMBODIMENTS

Figure 1:
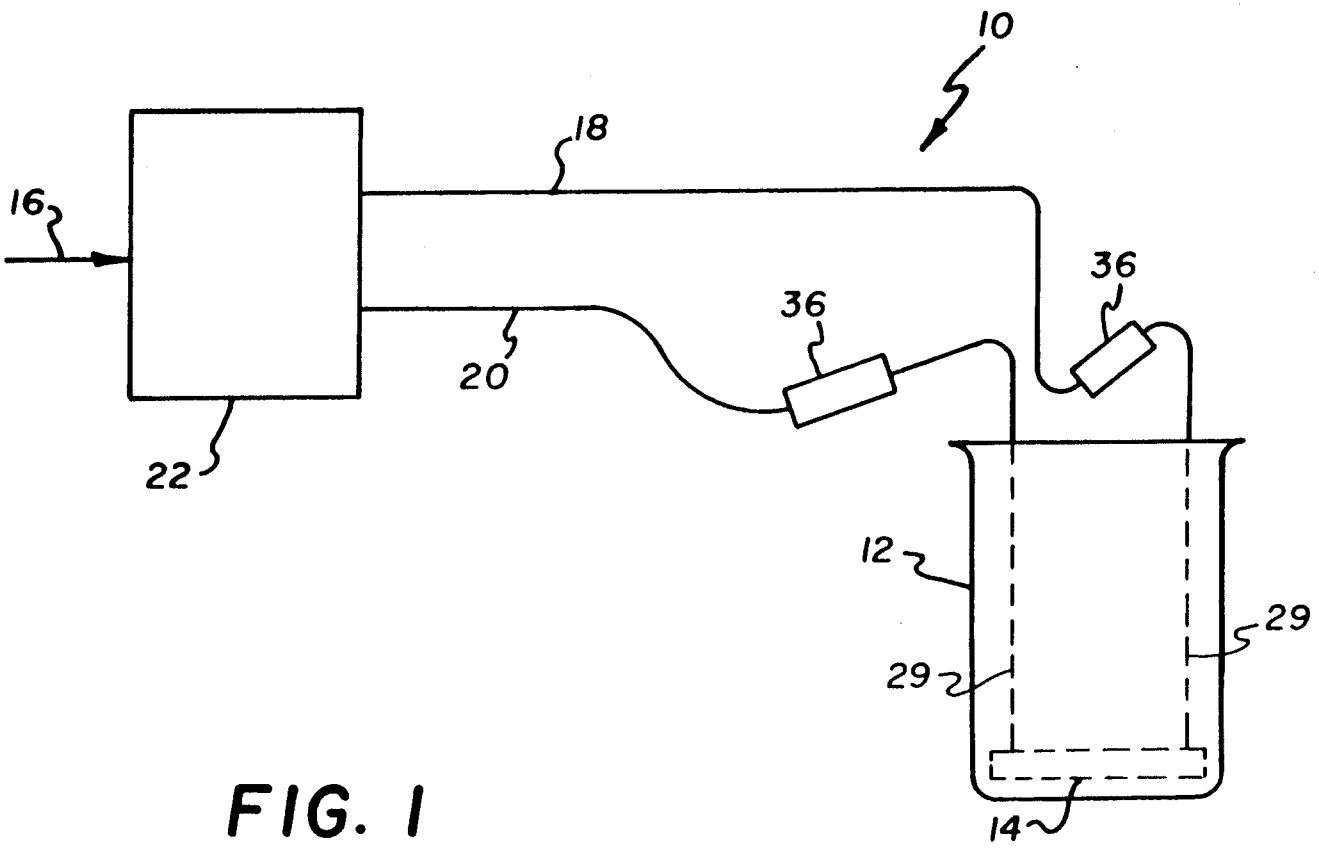
FIG. 1 shows a diagrammatic view of the film processing apparatus constructed in accordance with the invention.
Figure 2:
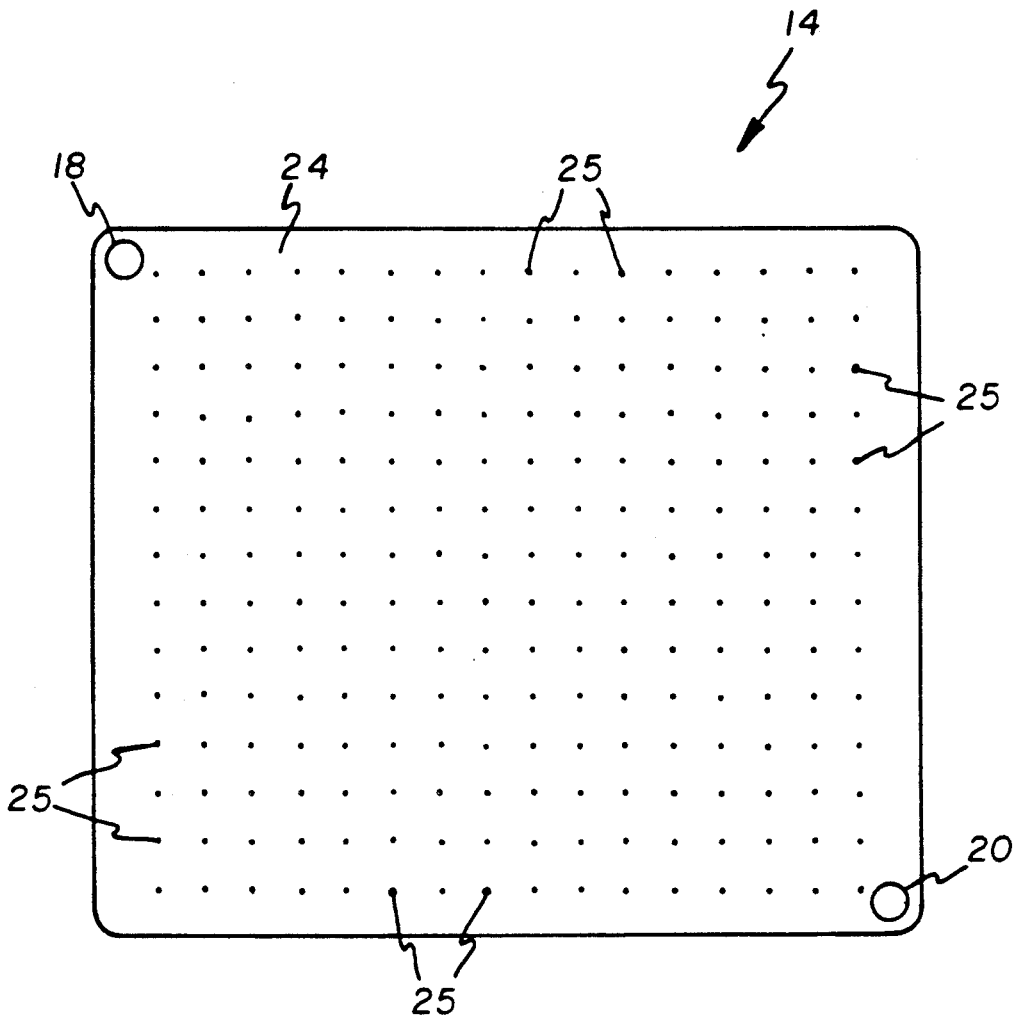
FIG. 2 is a schematic view of a gas distributor of the invention having a single gas distribution means.

Turning now to the drawings, and more particularly to FIG. 1 there is shown the photosensitive sheet processing apparatus 10 constructed in accordance with the present invention. The apparatus 10 generally comprises an open ended tank 12 for holding the processing solution. A gas distributor 14 is disposed in the bottom of the tank 12 and secured by any suitable means. Gas is provided to the gas distributor 14 by any suitable means 16 and supplied to the distributor by independent gas inlet lines 18,20. A bursting means 22 is provided for alternately and sequentially bursting a gas through the gas distributor 14, in a manner more fully described below, so that the gas burst during its upward movement produces uniform solution agitation. In a preferred embodiment, the gas distributor 14 comprises a single gas distribution means 24 (FIG. 2) having a plurality of spaced openings 25 and at least two gas inlet lines 18,20 for alternately providing a gas to the gas distribution means 14 such that the gas, in turn, can be alternately dispensed in the tank 12 in alternating bursting patterns.

Figure 3:
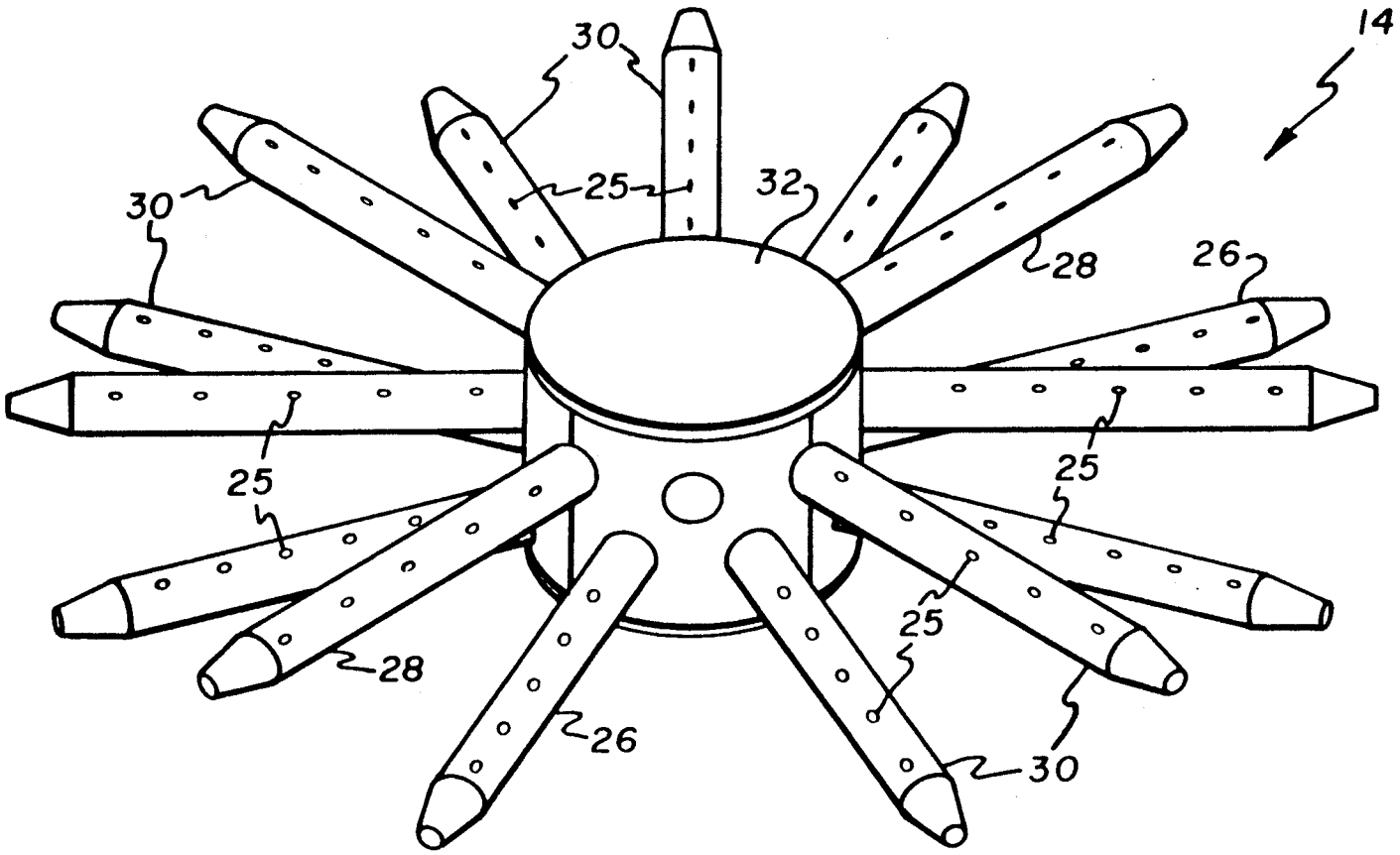
FIG. 3 is a schematic view of the star shaped embodiment of the invention.
Figure 4:
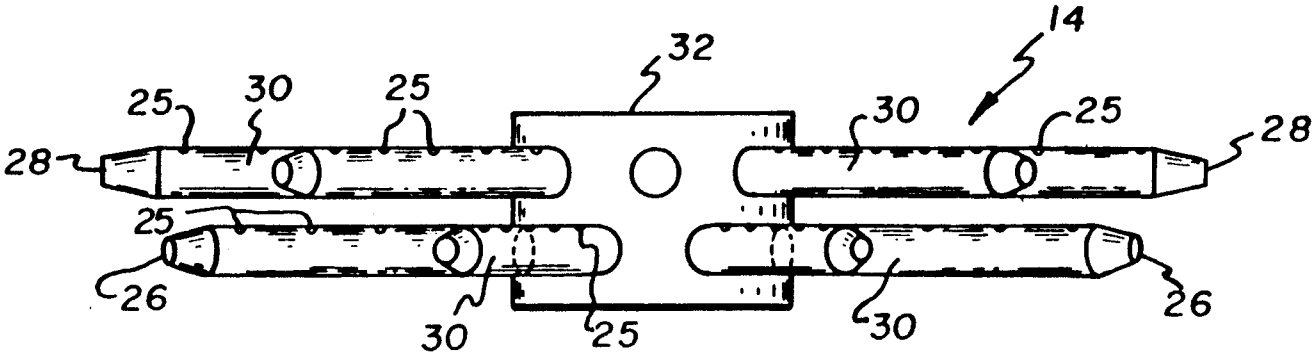
FIG. 4 shows a side elevation view of FIG. 3.
Figure 5:
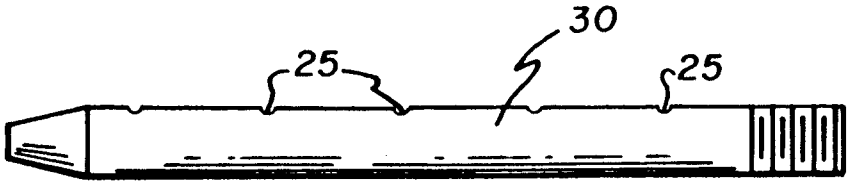
FIG. 5 shows a plan view of a dispensing duct.

In another preferred embodiment, the gas distributor 14 is substantially star shaped comprising independent first and second gas distribution means 26,28 as shown in FIG. 3. Distributor 14 is preferably made of a thermoplastic polymeric material, although any material, such as metal, may be used. Gas distribution means 26,28 each comprises a plurality of radially extending closed ended dispensing ducts 30 emanating from a central hub 32. Hub 32 has interior channels (not shown) for each gas distribution means 26,28. Moreover, gas distribution means 26,28 are in substantially parallel planes with dispensing ducts 30 in opposing planes being displaced from one another such that dispensing ducts 30 in one plane do not interfere with dispensing ducts 30 in the remaining plane (FIGS. 3 and 4). In this way, there is no interference to the upward burst pattern of the processing solution during alternate bursting of the gas distribution means 26,28. The dispensing ducts 30 have a plurality of spaced openings 25 (FIG. 5) along their lengths through which the gas is emitted. Hub 32 has independent gas inlet lines 18,20 (FIGS. 3 & 6), respectively, that supply gas to distribution means 26,28. Any gas may be used such as air or nitrogen. In this embodiment, the pattern of gas that is emitted from the gas distribution means 26,28 through dispensing ducts 30 moves in sequence from first gas distribution means 26 and then, during the following burst, from second gas distribution means 28. More particularly, the gas moves through a first gas distribution means 26 into the processing solution resulting in a plurality of intersecting planes of bubbles travelling upwardly through the solution relative to the film strips suspended in the tank 12. A subsequent burst of the second distribution means 28 results in a corresponding plurality of planes of bubbles travelling upwardly through the solution relative to the film strips. Repeated alternating burst of the distribution means 26,28 of this embodiment provides for the uniform agitation of the processing solution. Experiments indicate that a preferred burst cycle is for one gas distribution means 26,28 to burst for a 2 seconds interval followed by an 8 second interval of no burst, followed by 2 second burst interval of the other gas distribution means 28,26. A commercially available Burster/timer, CX 100 series, manufactured by Eagel Signal Controls is preferred for controlling the on/off burst cycle of the gas distribution means 26,28, although any suitable bursting means 22 may be used.

Any means 29 for holding the photosensitive sheets in the solution may be used such that substantially the entire sheet is exposed to the solution as shown in FIG. 1. A basket such as the one described in U.S. Pat. No. 3,291,025 provides a suitable holding means for the sheets during processing.

Figure 6:
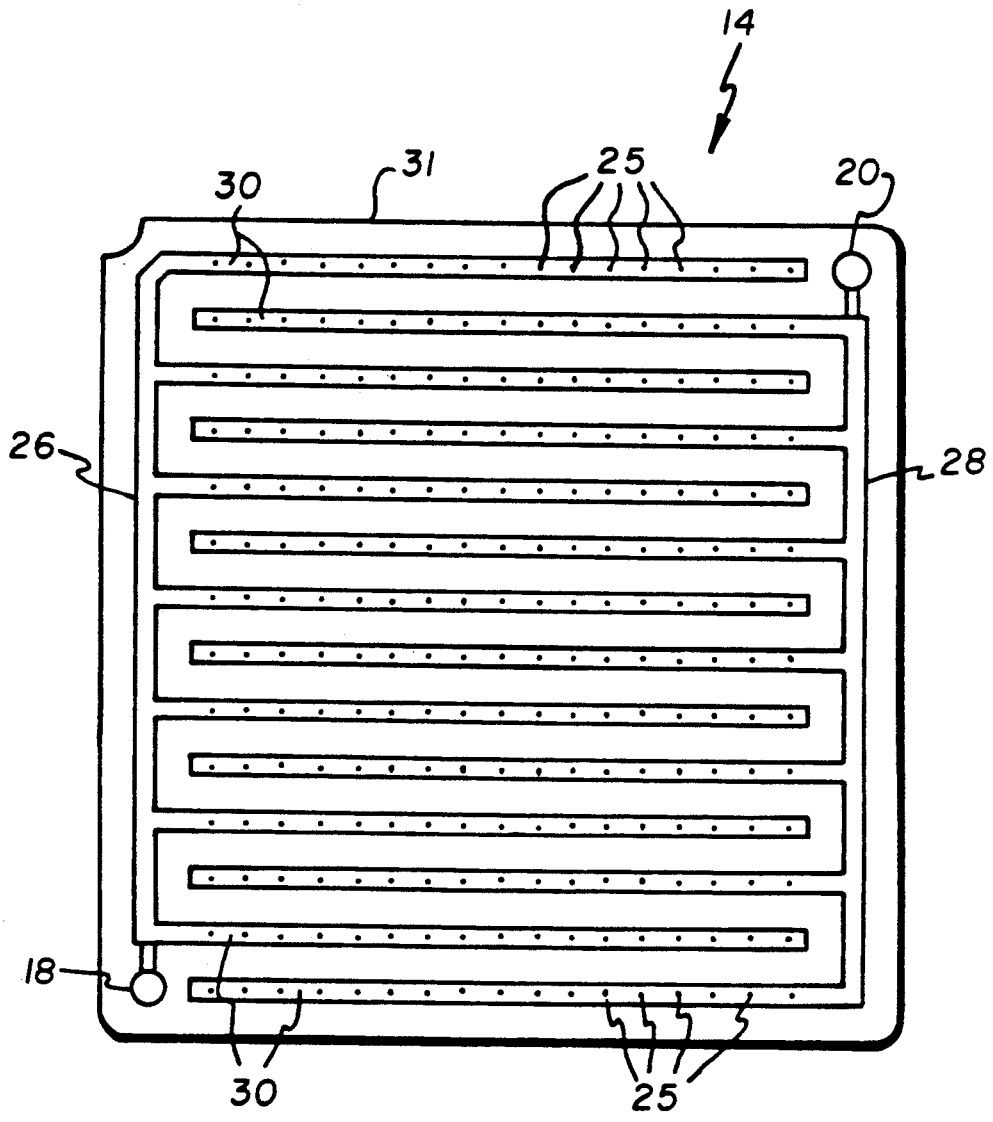
FIG. 6 is a top view of the square shaped embodiment of the invention.
Figure 7:
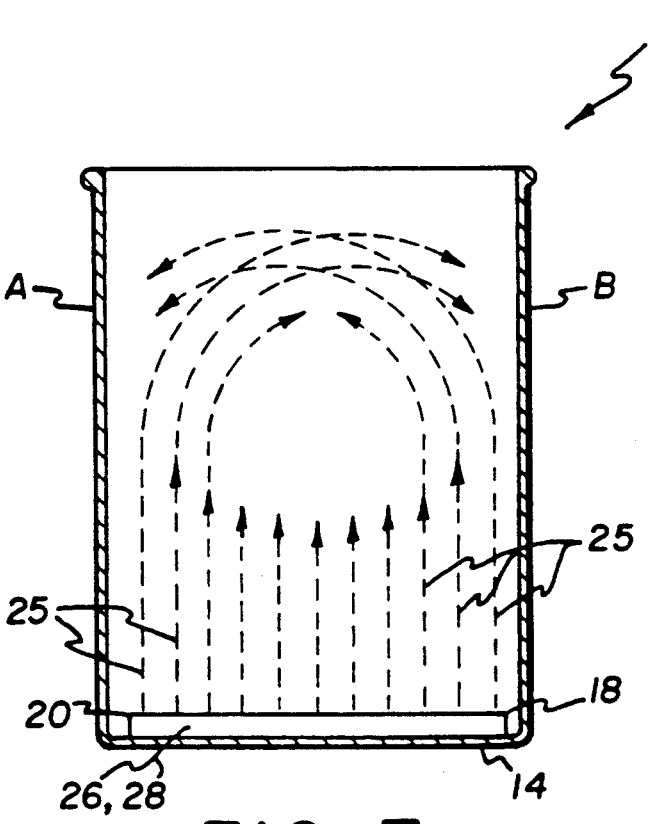
FIG. 7 shows a schematic view of the solution flow pattern in the processing tank using the square shaped gas distributor of the invention; and, FIG. 8 is a sectional view along the 8—8 line of FIG. 6.

In another preferred embodiment, the gas distributor 14 is a substantially square shaped member 31 having a first and second distribution means 26,28 milled in a common plane of member 31, as shown in FIG. 6. Distribution means 26,28 each has a plurality of closed ended dispensing ducts 30 having spaced openings 25 along their lengths for dispensing a gas into the processing solution. Member 31 is preferably made of a thermoplastic polymeric material, although any suitable material, such as metal, may be used. In this embodiment, the dispensing ducts 30 of first distribution means 26 alternate in the same plane of member 31 with dispensing ducts 30 of the second distribution means 28. Gas inlet lines 18,20 are brought into member 31 from opposite corners of the gas distributor 14 as shown in FIG. 6. While the square shaped distributor operates substantially like the star shaped embodiment of the invention to produce uniform agitation of the processing solution, observations indicate as the gas flows through one distribution means 26 and into the solution via the spaced openings 25 in the dispensing ducts 30 the solution is effectively turned or rotated away from the dispensing duct 30 nearest the gas inlet line 18,20 and toward the wall (A) of tank 12 (FIG. 7). A subsequent burst of the remaining distribution means 28 from the opposing gas inlet line 20,18 effectively produces turning or rotation of the solution counter to the initial burst direction and towards the opposing wall (B) of the tank 12 (FIG. 7). Thus, repeated alternating burst of distribution means 26,28 of the square shaped distributor 14 provides for the uniform agitation of the processing solution relative to the film strips.

Figure 8:
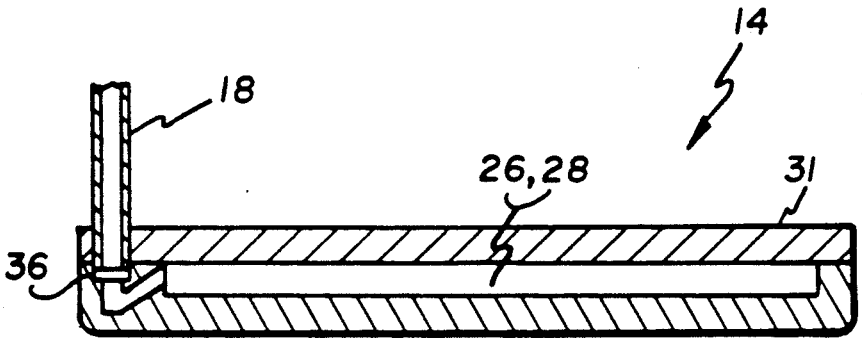

In yet another embodiment, the apparatus 10 has independent in-line check valves 36 for preventing the backflow of solution into the gas distributor 14 (FIG. 1). Although check valves 36 are preferably positioned outside of tank 12, alternatively, check valves 36 may also be operably interconnected to gas distributor 14 in tank 12 as shown in FIG. 8.

A more complete understanding of the present invention can be obtained by referring to the following illustrative examples of the practice of the invention, which examples are not intended, however, to be unduly limitative of the invention.

EXAMPLE 1

Experiments were carried out using the apparatus 10 of FIG. 1 and the gas distributors 14 of FIGS. 3 & 6. Commercially available color negative film, Kodak Gold 100®, and processing chemicals manufactured by the Eastman Kodak Company were used to evaluate the uniformity of the agitation in an 8 liter deep-tank processing unit as described in FIG. 1. Prior art gas distributors similar to that disclosed in U.S. Pat. No. 3,291,025 and the gas distributors of the present invention were tested. The process was operated at the recommended developer temperature of 100° F. The color negative film was chopped into 12 inch length strips for the convenience of mounting on preselected stainless steel or plastic racks. Each strip of film was given a neutral exposure for 0.04 seconds using a 1B sensitometer operating at a color temperature of 5500° K. The exposures were obtained using a neutral density stepped chart that had a density range from 0 to 4.0 in 21, nominally equal, density steps. For each processing test, 27 strips of film were exposed, mounted, and then simultaneously processed. The average red, green and blue density for each step was computed as was the corresponding variance using classical statistics and the data for all 27 strips. Further the average density and the $+/-2\sigma$ were plotted versus log Exposure for each color. The slope of these three density versus log Exposure plots was then determined using standard regression analysis. Slope (S) in the Table below is the slope corresponding to the average densities of the film strips. $S_1$ and $S_2$, respectively, correspond to the slopes of the $+2\sigma$ and $-2\sigma$ limits. The range R between $S_1$ and $S_2$ was also calculated. Finally, the coefficient of variance (C) defined as the relative noise in the process was calculated. Uniform solution agitation is favored by lower C's.

The gas distributor of this Example is a square plate that has one gas distribution means having a plurality of spaced openings that burst simultaneously when a gas is supplied. This plate arrangement corresponds to the prior art distributor described in U.S. Pat. No. 3,291,025. Nitrogen gas is supplied simultaneously from each gaseous inlet using a burst cycle of 2 seconds on and 8 seconds off. The regression slope for average density (S) and two sigma limits $S_1$ and $S_2$ for each color are shown in the Table below.

EXAMPLE 2

The gas distributor of Example 1 is used with alternating bursts according to the invention. In this embodiment, one nitrogen inlet is used to supply nitrogen to the single distribution means during the 2 second-on-burst and then the other nitrogen inlet is used. Data of the regression slopes for the average (S) and two sigma limits $S_1$ and $S_2$ for each color are shown to be markedly improved relative to the data of Example 1.

EXAMPLE 3

The substantially star shaped gas distributor as described above and shown in FIGS. 3 and 4 was used in place of the prior art gas distributor. The gas distributor has two nitrogen inlets and two gas distribution means, one for inlet for each distribution means. Alternating burst cycles of this embodiment lead to simultaneously alternating both the inlet supply of nitrogen and the distribution means. Tabulated data of the regression slope for the average and the two sigma limits for each color as shown below are markedly improved relative to the prior art Example 1. Additionally, the data in the Table below show that this embodiment is superior to Example 2 above although the extent of the improvement is not nearly as great as that exhibited in a comparison of Example 1 to that of Example 2.

EXAMPLE 4

The substantially square shaped gas distributor, as described in FIGS. 6, 7 and 8 having two nitrogen inlet lines and two gas distribution means, each distribution means having an inlet, replaced the distributor of Example 1. Alternating burst cycles of 2 seconds on and 8 seconds off with this embodiment lead to simultaneously alternating both the inlet supply of nitrogen and the distribution means. The data of the regression slope for the average and two sigma limits for each color are shown in the Table below to be markedly improved relative to Example 1.

TABLE

| EXAMPLE | COLOR NEG. FILM | Slope S | Slope $S_1$ | Slope $S_2$ | Range (R) | Var. (C) |
|---|---|---|---|---|---|---|
| 1 | RED | 0.602 | 0.638 | 0.566 | 0.072 | 12.0 |
| | GREEN | 0.636 | 0.669 | 0.604 | 0.065 | 10.2 |
| | BLUE | 0.701 | 0.735 | 0.667 | 0.068 | 9.7 |
| 2 | RED | 0.597 | 0.607 | 0.587 | 0.020 | 3.4 |
| | GREEN | 0.644 | 0.653 | 0.634 | 0.019 | 3.0 |
| | BLUE | 0.698 | 0.712 | 0.683 | 0.029 | 4.2 |
| 3 | RED | 0.574 | 0.581 | 0.567 | 0.014 | 2.4 |
| | GREEN | 0.605 | 0.612 | 0.598 | 0.014 | 2.3 |
| | BLUE | 0.647 | 0.655 | 0.638 | 0.017 | 2.6 |
| 4 | RED | 0.613 | 0.617 | 0.609 | 0.008 | 1.3 |
| | GREEN | 0.657 | 0.665 | 0.648 | 0.017 | 2.6 |
| | BLUE | 0.709 | 0.718 | 0.699 | 0.019 | 2.7 |

The data above show that the gas distributors of the invention, particularly the substantially star and square shaped distributors, produce significantly lower (4–5× less) variability in sensitometric characteristics compared to the prior art distributor.

The invention has been described in detail with particular reference to preferred embodiments thereof, but it will be understood that variations and modifications can be effected within the spirit and scope of the invention as described hereinabove and as defined in the appended claims.

What is claimed is:

1. Apparatus for processing sheets of photosensitive material disposed in a tank containing a processing solution, said apparatus comprising:

a) a gas distributor disposed in said solution, said gas distributor having at least two independent gas inlet lines for alternately receiving a gas, said distributor further having a plurality of spaced openings for dispensing the gas into the tank;

b) means for holding the photosensitive sheets in the solution; and, c) means connected to said gas inlet lines for alternately bursting the gas through said gas distributor such that said gas burst during its upward movement passes along the surface of said sheets to provide uniform solution agitation.

2. The apparatus recited in claim 1 further comprising valve means operably interconnected in each of said independent gas inlet lines for preventing the backflow of processing solution into said gas distributor.

3. The apparatus recited in claim 2 wherein each of said valve means is positioned outside said tank.

4. Apparatus for processing sheets of photosensitive material disposed in a tank containing a processing solution, said apparatus comprising:

a) a gas distributor disposed in said solution, said distributor having at least two independent gas distribution means for alternately dispensing a gas into said tank in alternating patterns, said gas distribution means further having independent gas inlet lines for providing a gas to said gas distribution means;

b) means for holding the photosensitive sheets in the solution;

c) means for supplying a gas to each of said independent gas inlet lines; and d) means for alternately bursting the gas through each of said gas distribution means such that said gas burst during its upward movement passes along the surface of said sheets to provide uniform solution agitation.

5. The apparatus recited in claim 4 further comprising a valve means operably interconnected in each of said gas inlet lines for preventing the backflow of processing solution into said gas distribution means.

6. The apparatus recited in claim 4 wherein each of said valve means is positioned outside said tank.

7. The apparatus recited in claim 4 wherein said gas distributor comprises a substantially star shaped, independent first and second gas distribution means, said distribution means having a plurality of closed ended dispensing ducts radially extending from a common hub and wherein said dispensing ducts have a plurality of spaced openings along their lengths for emitting a gas into the processing solution.

8. The apparatus recited in claim 4 wherein said gas distributor comprises a substantially square shaped member, said member having independent first and second gas distribution means, said gas distribution means having a plurality of closed ended dispensing ducts, dispensing ducts for said first gas distribution means alternating in a common plane with said dispensing ducts of said second gas distribution means, and wherein said dispensing ducts each has a plurality of spaced openings along their lengths for emitting a gas into the processing solution.

9. The apparatus recited in claim 4 wherein each of said gas distribution means alternately in sequence burst for an interval period followed by a non-burst interval period.

10. The apparatus recited in claim 9 wherein said burst interval period is substantially shorter than said non-burst interval period.

11. The apparatus of claim 10 wherein each of said burst interval period is about 2 seconds and said non-burst interval about 8 seconds.

12. Apparatus for producing uniform agitation of a solution in a tank, said apparatus comprising:

a) at least two independent structurally interconnected, spaced apart gas distribution means for insertion in the bottom of the tank;

b) said distribution means each comprising a plurality of closed ended dispensing ducts, said dispensing ducts having a plurality of spaced openings for delivering a gas into the solution; and, c) said distribution means each having independent gas inlet lines for receiving a gas such that each of said gas distribution means dispense a gaseous burst into said tank in alternating patterns for upward movement through the solution.

13. The apparatus recited in claim 12 wherein said first and second gas distribution means each is substantially star shaped and in substantially parallel planes.

14. The apparatus recited in claim 12 wherein said gas distribution means are in a common plane and are substantially square shaped.

15. A method of processing sheets of photosensitive material in a tank containing a processing solution, said method comprising:

a) disposing a gas distributor comprising a pair of independent gas distribution means into said solution;

b) inserting the photosensitive material into the solution;

c) providing a gas to said gas distributor;

d) sequentially activating the flow of gas into one of said independent gas distribution means for a burst interval period followed by a rest interval period;

e) sequentially activating the flow of gas into the other independent distribution means for a burst interval period followed by a rest interval period;

f) repeating the cycles in steps (d) and (e) until the photosensitive material is processed; and, g) removing the photosensitive material from said tank after step (f).

16. The method of claim 15 wherein said burst interval periods of steps (c) and (d) are equal and said rest interval periods of steps (c) and (d) are equal.

17. The method of claim 15 wherein each of said burst interval period is about 2 seconds and said rest interval period is about 8 seconds.

* * * * *